US007726073B2

(12) United States Patent
Ifko

(10) Patent No.: US 7,726,073 B2
(45) Date of Patent: Jun. 1, 2010

(54) SLIDING SHOE FOR A WINDOW FRAME

(75) Inventor: Stefan Ifko, Woodbridge (CA)

(73) Assignee: S.I.L. Plastic Sales & Supplies Inc., Woodbridge, Ontario (CA)

( * ) Notice: Subject to any disclaimer, the term of this patent is extended or adjusted under 35 U.S.C. 154(b) by 713 days.

(21) Appl. No.: 11/401,402

(22) Filed: Apr. 11, 2006

(65) Prior Publication Data

US 2006/0230682 A1 Oct. 19, 2006

(30) Foreign Application Priority Data

Apr. 14, 2005 (CA) ..... 2504190

(51) Int. Cl.
*E05D 15/22* (2006.01)

(52) U.S. Cl. ..... 49/181

(58) Field of Classification Search ..... 49/176, 49/181, 445, 447; 16/197
See application file for complete search history.

(56) References Cited

U.S. PATENT DOCUMENTS 3,055,063 A * 9/1962 Peters ..... 49/174
3,399,490 A * 9/1968 Hettinger ..... 49/414
3,434,236 A * 3/1969 Benigno et. al. ..... 49/176
4,068,406 A * 1/1978 Wood ..... 49/181
4,452,012 A * 6/1984 Deal ..... 49/181
4,610,108 A * 9/1986 Marshik ..... 49/181
4,683,676 A * 8/1987 Sterner, Jr. ..... 49/181
4,718,194 A * 1/1988 FitzGibbon et al. ..... 49/181
4,854,077 A * 8/1989 Rogers et al. ..... 49/322
4,888,915 A * 12/1989 Goldenberg ..... 49/181
4,958,462 A * 9/1990 Cross ..... 49/181
5,027,557 A * 7/1991 May ..... 49/181
5,069,001 A * 12/1991 Makarowski ..... 49/176
5,127,192 A * 7/1992 Cross ..... 49/181
5,168,665 A * 12/1992 Goldenberg ..... 49/172
5,210,976 A * 5/1993 Cripps ..... 49/181
5,237,775 A 8/1993 Hardy
5,243,783 A * 9/1993 Schmidt et al. ..... 49/181
5,301,467 A * 4/1994 Schmidt et al. ..... 49/181
5,353,548 A * 10/1994 Westfall ..... 49/446
5,371,971 A * 12/1994 Prete ..... 49/380
5,377,384 A * 1/1995 Riegelman ..... 16/193
5,406,749 A * 4/1995 Goldenberg ..... 49/178
5,414,960 A * 5/1995 O'Donnell et al. ..... 49/177
5,463,793 A * 11/1995 Westfall ..... 16/197
5,566,507 A * 10/1996 Schmidt et al. ..... 49/428
5,632,117 A * 5/1997 Prete et al. ..... 49/181
5,669,180 A * 9/1997 Maier ..... 49/181

(Continued)

*Primary Examiner*—Katherine W Mitchell
*Assistant Examiner*—Michael J Keller
(74) *Attorney, Agent, or Firm*—Dimock Stratton LLP; Mark Eisen

(57) ABSTRACT

A sliding shoe for a sliding/pivoting window having a shoe body which is of two piece construction. A cam trapped between the two portions of the shoe has a cam-shaped body, which rotates in complementary cam-shaped openings through the shoe portions to expand the shoe laterally, and a chamfered cam-shaped annulus which rotates in a complementary bevelled seat in the shoe body to expand the shoe in a direction perpendicular to the lateral expansion. The shoe is thus locked in position in the frame channel very early in the rotational cycle of the cam, and provide secure locking engagement against the sides, top and bottom of the channel when the sash is pivoted only slightly out of the plane of the frame.

20 Claims, 7 Drawing Sheets

U.S. PATENT DOCUMENTS 5,697,188 A * 12/1997 Fullick et al. ..... 49/181
5,704,165 A * 1/1998 Slocomb et al. ..... 49/181
5,802,767 A * 9/1998 Slocomb et al. ..... 49/181
5,806,243 A * 9/1998 Prete et al. ..... 49/181
5,829,196 A * 11/1998 Maier ..... 49/181
5,924,243 A * 7/1999 Polowinczak et al. ..... 49/181
5,927,013 A * 7/1999 Slocomb et al. ..... 49/181
5,927,014 A * 7/1999 Goldenberg ..... 49/182
5,943,822 A * 8/1999 Slocomb et al. ..... 49/181
6,032,417 A * 3/2000 Jakus et al. ..... 49/181
6,058,653 A * 5/2000 Slocomb et al. ..... 49/181
6,119,398 A * 9/2000 Yates, Jr. ..... 49/181
6,161,335 A * 12/2000 Beard et al. ..... 49/181
6,332,288 B1 * 12/2001 Guillemet et al. ..... 49/181
6,550,184 B1 * 4/2003 O'Donnell et al. ..... 49/181
6,658,794 B1 * 12/2003 Hansel et al. ..... 49/181
6,886,295 B2 * 5/2005 Annes et al. ..... 49/181
6,901,702 B2 * 6/2005 Liang et al. ..... 49/181
6,915,609 B2 * 7/2005 O'Donnell et al. ..... 49/181
6,931,788 B2 * 8/2005 Uken et al. ..... 49/181
7,194,839 B2 * 3/2007 O'Donnell et al. ..... 49/181
7,197,849 B2 * 4/2007 Liang et al. ..... 49/181
2005/0016065 A1 * 1/2005 Braid ..... 49/181

* cited by examiner

SLIDING SHOE FOR A WINDOW FRAME

FIELD OF THE INVENTION

This invention relates to a sliding shoe for a window frame. In particular, this invention relates to a sliding shoe for mounting a window to a channel in a window frame while allowing sliding and pivotal movement.

BACKGROUND OF THE INVENTION

Modern double-hung and casement windows are typically mounted in an aluminium or vinyl outer frame or jamb, on a pivot mechanism that provides means for both sliding the window sash relative to the outer frame and tilting the window sash out of the plane of the frame. This facilitates easier assembly of the window sash to the frame, and cleaning of the window after installation.

In a typical sliding/pivoting window construction, the window sash is mounted at one end on opposed pivot pins which are disposed in sliding shoes, each shoe being respectively trapped in a channel formed in the outer frame. This allows the window sash to slide along the frame within the plane of the frame like a sliding window, or to be pivoted out of the plane of the frame like a pivoting window. This provides considerable versatility in the positioning of the window within the frame by a user.

It is advantageous, both for safety reasons and to facilitate cleaning of the window, that when the window sash is pivoted out of the plane of the frame the window sash be prevented from sliding along the frame. Accordingly, it is known to provide a sliding shoe which can be expanded to lock against the channel in the window frame. For example, U.S. Pat. No. 5,168,665 issued Dec. 8, 1992 to Goldenberg, which is incorporated herein by reference, teaches a sliding pivot shoe assembly having a body with a split end and a cam disposed in the body adjacent to the split end. When the cam is rotated, the body expands to engage the sides of the channel in the frame. The window sash is pivotally mounted on the cam by a pivot pin keyed to the cam, so that when the window sash is pivoted out of the plane of the frame the cam rotates and the shoe body frictionally locks into position in the channel.

However, there are different mechanisms used to bias the window sash to a closed position in the frame, by to biasing the shoe to an end of the channel, and prior art sliding shoes are not adapted to be used with these various different mechanisms. Furthermore, because the prior art sliding shoes are of a unitary construction, the cam is not trapped in the shoe and can become displaced when the sash pivot is mounted into the cam, and the shoe can expand only in the lateral direction, relying solely on the sides of the shoe to engage the sides of the channel. Also, in prior art shoes the spreading action occurs very slowly in the rotational cycle of the cam, and thus the window locks into position in the frame only when the window sash is pivoted almost completely out of the plane of the frame, which is undesirable. The faster the shoe gets into the lock position, the less chance the sash has to move while locking.

SUMMARY OF THE INVENTION

The present invention overcomes these disadvantages by providing a sliding shoe for a sliding/pivoting window having a shoe body which is of two piece construction. A cam is trapped between the two portions of the body, ensuring that the cam remains properly seated during both installation and operation. Furthermore, the sliding shoe of the present invention is easily adapted to operate with different biasing mechanisms, which can be anchored to anchoring means trapped within the shoe body by closing the two pieces of the shoe body over the anchoring means.

In the preferred embodiment the cam is provided with a cam-shaped body, which rotates in complementary cam-shaped openings through the shoe portions to expand the shoe laterally, and an annulus which rotates in a complementary bevelled seat in the shoe body. In the preferred embodiment the annulus and cam seat are also cam-shaped, preferably chamfered, so the action of the cam is enhanced and the shoe can expand in a direction perpendicular to the lateral expansion, to lock the shoe in position in the channel very early in the rotational cycle of the cam and provide secure locking engagement against the sides, top and bottom of the channel when the sash is pivoted only slightly out of the plane of the frame. This provides a more positive locking effect as the cam is rotated. The shoe of the invention is also symmetrical about both longitudinal planes, so a single shoe configuration can be used for both sides (or top and bottom) of the window.

The invention thus provides a shoe for supporting a window sash frame in an outer frame, the shoe being slidably received in a channel in the outer frame comprising a top, a bottom and side walls, the shoe comprising a cam having a cam body extending from each end of an annulus, the cam body having a wider diameter and a narrower diameter, first and second mating shoe portions, each portion having an opening in communication with an end of the shoe portion, the opening having a wider diameter and a narrower diameter complementary to the cam body, the annulus having a wider thickness and a narrower thickness and being seated in a cam seat circumscribing the opening and having a wider thickness and a narrower thickness complementary to the annulus, such that when the cam is in a rest position with the wider diameter of the cam aligned with the wider diameter of the opening, the wider thickness of the annulus is aligned with the wider thickness of the cam seat and the first and second mating shoe portions are in an unlocked position, and the cam comprising a pivot receptacle for receiving a pivot pin of a window sash in rotationally fixed relation, such that pivoting the window sash rotates the cam, whereby when the window is pivoted out of a plane containing the outer frame, the cam body expands the shoe portions laterally and the annulus cooperates with the cam seat to force the shoe portions apart and causing the shoe to expand in a direction perpendicular to the lateral expansion.

The invention further provides a window comprising a window sash frame in an outer frame, and further comprising a shoe slidably received in a channel in the outer frame comprising a top, a bottom and side walls, the shoe comprising a cam having a cam body extending from each end of an annulus, the cam body having a wider diameter and a narrower diameter, first and second mating shoe portions, each portion having an opening in communication with an end of the shoe portion, the opening having a wider diameter and a narrower diameter complementary to the cam body, the annulus having a wider thickness and a narrower thickness and being seated in a cam seat circumscribing the opening and having a wider thickness and a narrower thickness complementary to the annulus, such that when the cam is in a rest position with the wider diameter of the cam aligned with the wider diameter of the opening, the wider thickness of the annulus is aligned with the wider thickness of the cam seat and the first and second mating shoe portions are in an unlocked position, and the cam comprising a pivot receptacle for receiving a pivot pin of a window sash in rotationally fixed relation, such that pivoting the window sash rotates the cam, whereby when the window is pivoted out of a plane containing the outer frame, the cam body expands the shoe portions laterally and the annulus cooperates with the cam seat to force the shoe portions apart and causing the shoe to expand in a direction perpendicular to the lateral expansion.

The invention further provides a kit of parts for assembling a window, comprising a window sash, an outer frame for supporting the window sash, comprising a channel comprising a top, a bottom and side walls, and a shoe slidably received in the channel, comprising a cam having a cam body extending from each end of an annulus, the cam body having a wider diameter and a narrower diameter, first and second mating shoe portions, each portion having an opening in communication with an end of the shoe portion, the opening having a wider diameter and a narrower diameter complementary to the cam body, the annulus having a wider thickness and a narrower thickness and being seated in a cam seat circumscribing the opening and having a wider thickness and a narrower thickness complementary to the annulus, such that when the cam is in a rest position with the wider diameter of the cam aligned with the wider diameter of the opening, the wider thickness of the annulus is aligned with the wider thickness of the cam seat and the first and second mating shoe portions are in an unlocked position, and the cam comprising a pivot receptacle for receiving a pivot pin of a window sash in rotationally fixed relation, such that pivoting the window sash rotates the cam, whereby when the window is pivoted out of a plane containing the outer frame, the cam body expands the shoe portions laterally and the annulus cooperates with the cam seat to force the shoe portions apart and causing the shoe to expand in a direction perpendicular to the lateral expansion.

In a further aspect of the invention, the annulus and the cam seat are chamfered.

BRIEF DESCRIPTION OF THE DRAWINGS

In drawings which illustrate by way of example only a preferred embodiment of the invention.

DETAILED DESCRIPTION OF THE INVENTION

Figure 1:
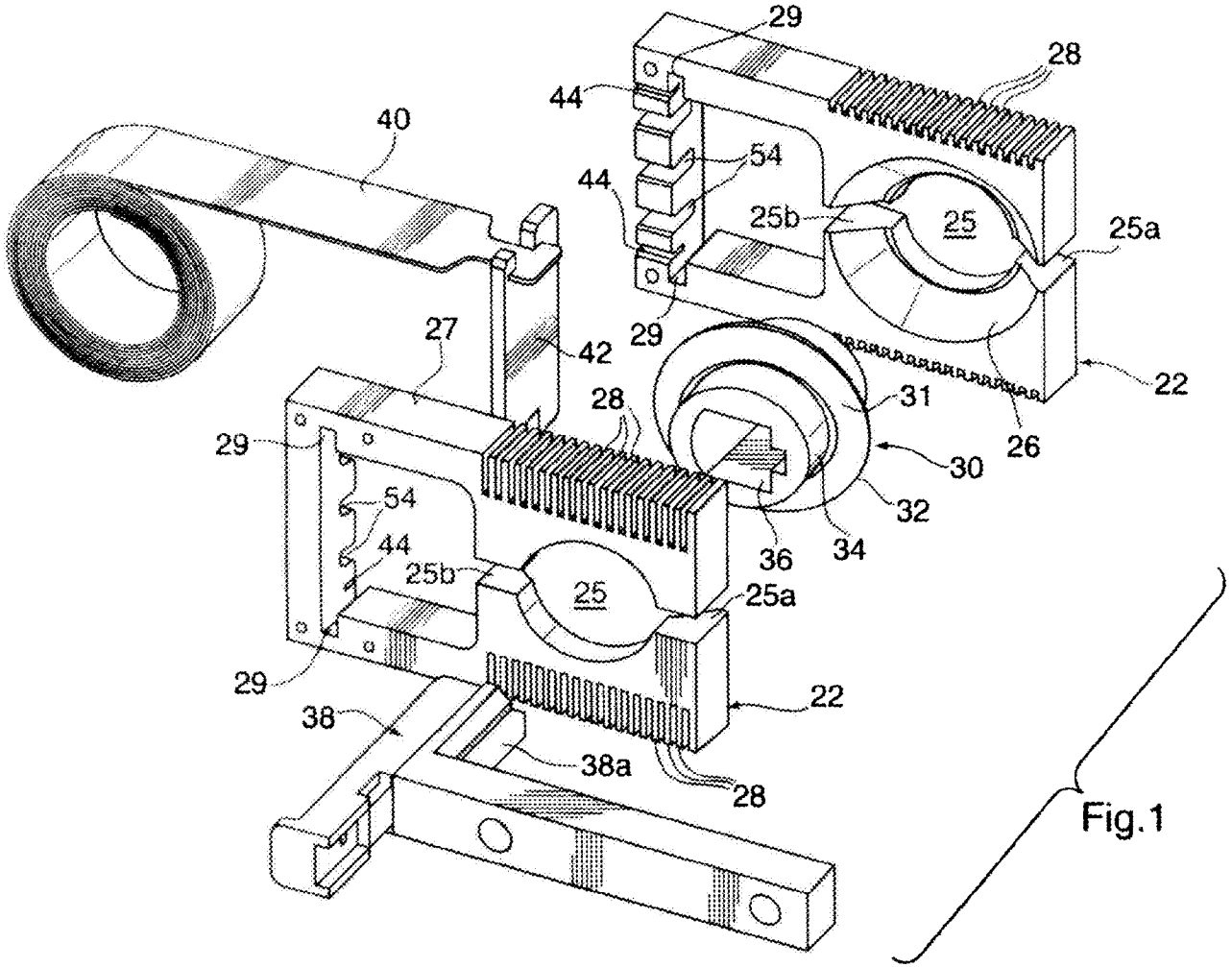
FIG. 1 is an exploded view of a cam according to the invention for a window utilizing a first biasing means.
Figure 2:
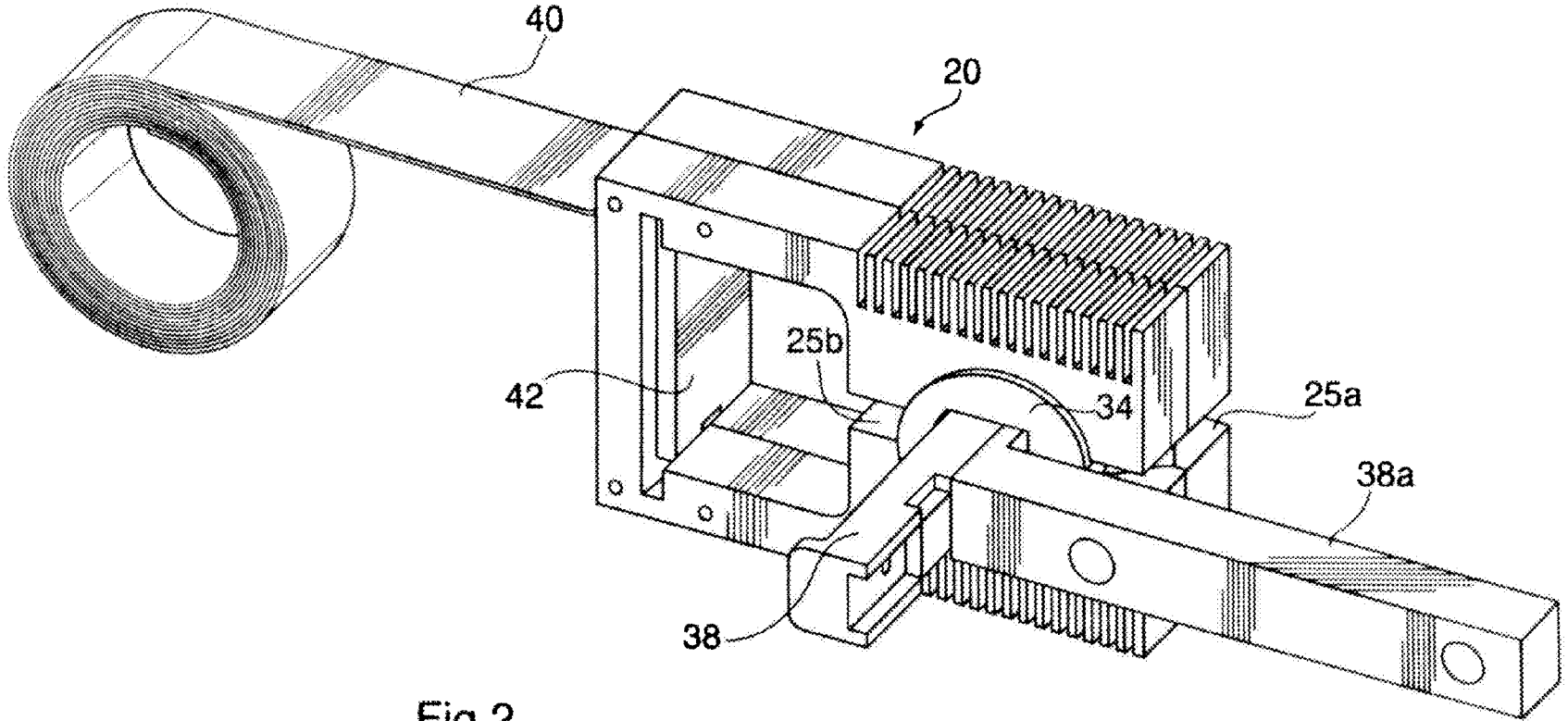
FIG. 2 is an exploded view of the cam of FIG. 1 for a window utilizing a second biasing means.
Figure 8:
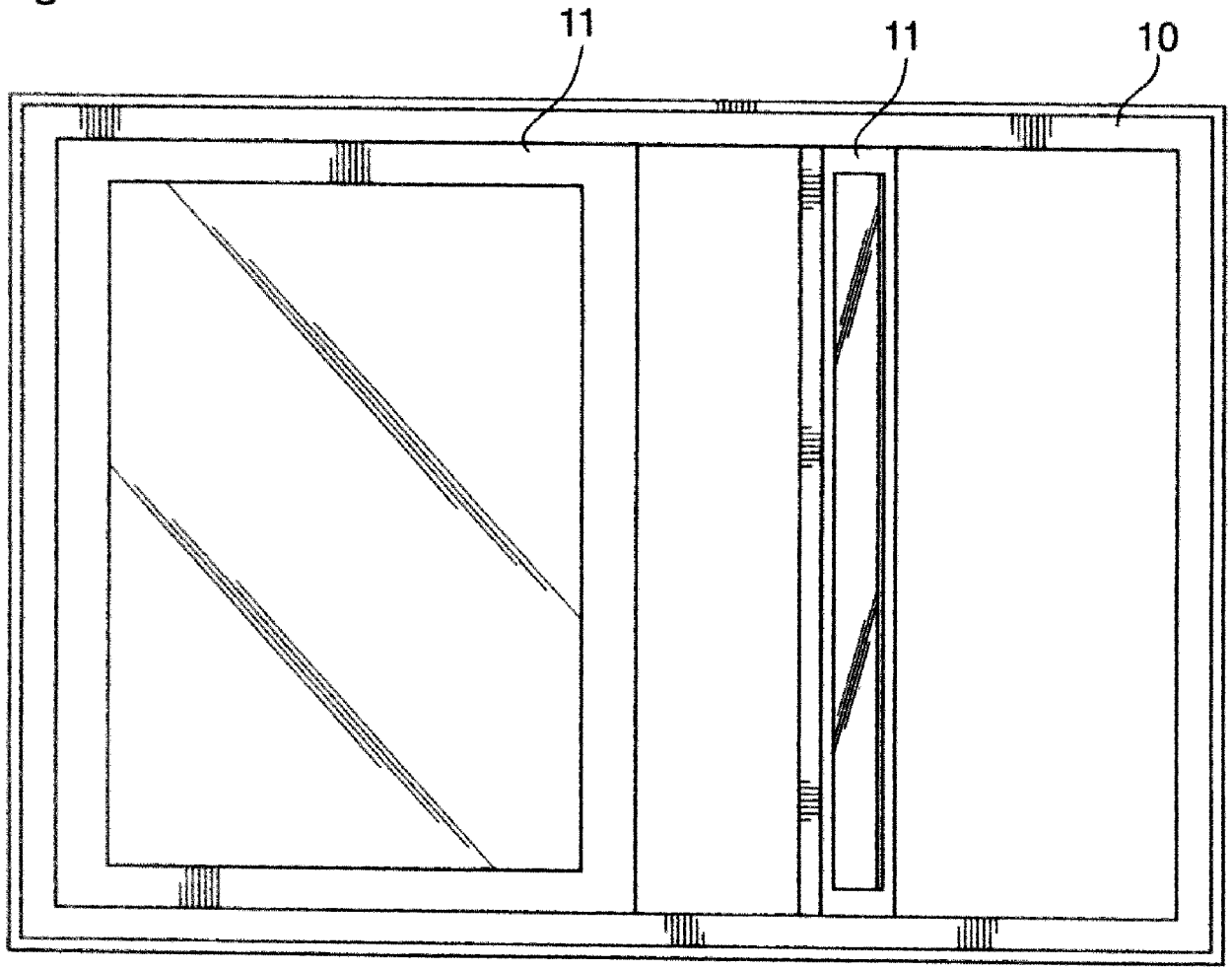
FIG. 8 is an elevation of a casement window embodying the invention showing one window pivoted out of the plane of the frame.

FIGS. 1 and 2 illustrate a sliding shoe 20 according to the invention for a sliding/pivoting window, for example of the type described and illustrated in U.S. Pat. No. 5,168,665, which is incorporated herein by reference. It will be appreciated that the window 2 may be a double-hung window, a casement window such as that illustrated in FIG. 8, or any other type of window in which the window sash 11 both slides and pivots relative to the outer frame 10.

Figure 3:
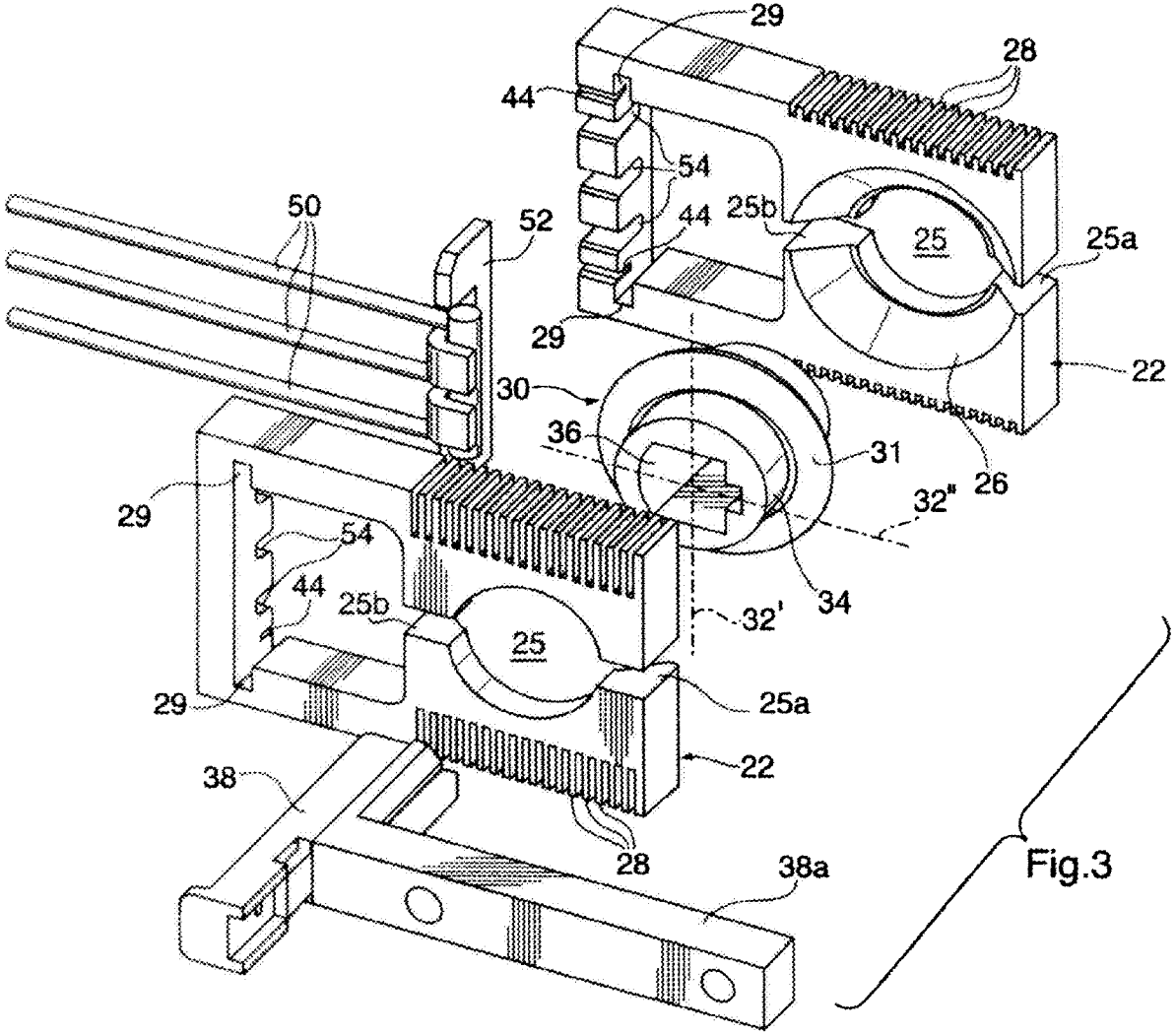
FIG. 3 is a perspective view of the assembled sliding shoe of FIG. 1.
Figure 6A:
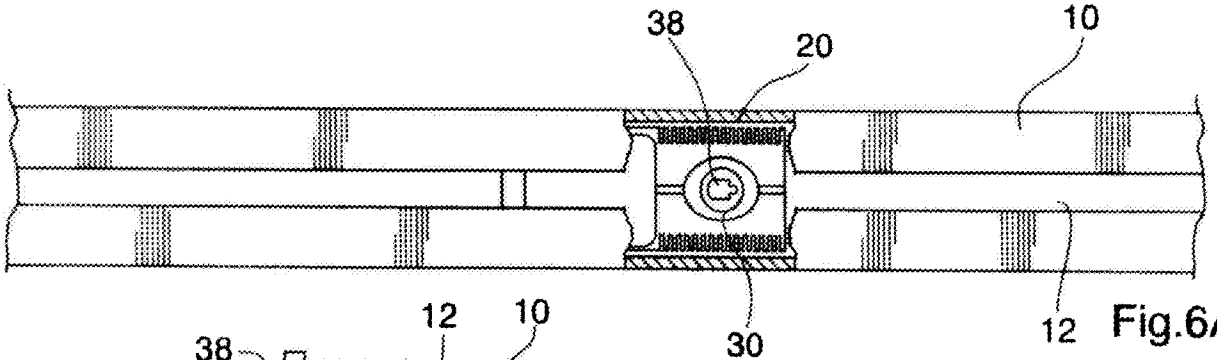
FIG. 6A is a cutaway plan view of a frame containing the shoe of FIG. 1 with the cam in a sliding position.
Figure 6B:
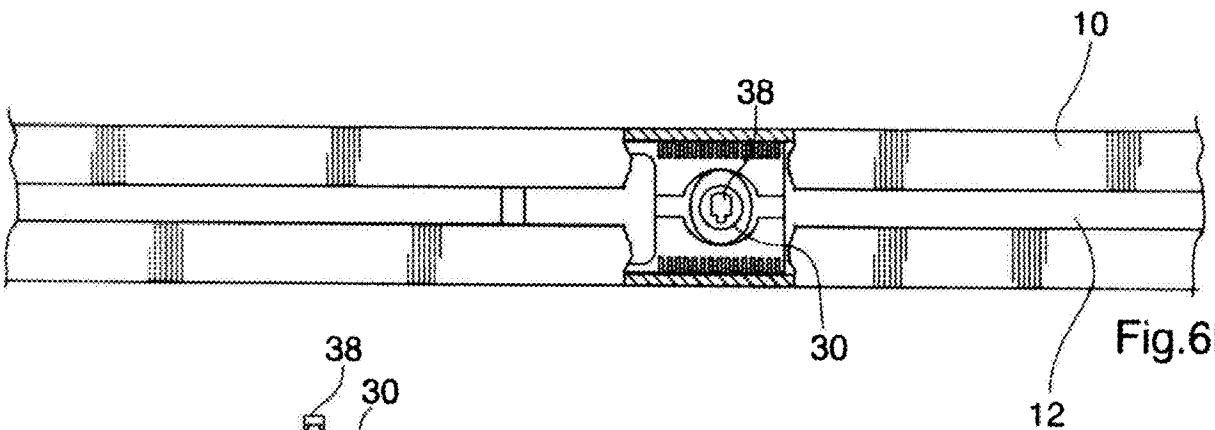
FIG. 6B is a cutaway plan view of a frame containing the shoe of FIG. 1 with the cam in a locked position.

As shown in FIGS. 6A and 6B, the frame 10 comprises a channel 12 which traps the sliding shoe 20 in sliding relation. The shoe 20 according to a preferred embodiment of the invention comprises a shoe body 22 having upper and lower shoe body portions 22. The shoe body portions 22 are provided with opposed cam seats 26, which in the preferred embodiment are bevelled. The exterior sides 27 of the shoe body 22 are preferably provided with a frictional surface, for example ribs as at 28, so that when the shoe body 22 is expanded to the locked position shown in FIG. 6B, the ribs 28 engage against the side of the channel 12, to lock the shoe 20 securely in position in the frame 10. In the preferred embodiment the ribs 28 extend over the top and bottom surfaces of the shoe 20, as shown in FIG. 3, for frictional engagement against top and bottom surfaces of the channel 12, as will be described in more detail below.

The cam 30 preferably comprises a chamfered annulus 32 complimentary to the cam seats 26, and a cam-shaped (for example oval or ovate) body portion 34 disposed through complimentary openings 25 through the shoe body portions 22. The cam 30 is also provided with a pivot receptacle 36, keyed to provide rotationally fixed engagement to the sash pivot pin 38, for example by a projecting portion 38*a*. The openings are in communication with the end of the shoe portion through a slot 25*a*, and preferably a similar slot 25*b* is provided in diametric opposition to the slot 25*a*allowing the sides of the shoe portion 22 to spread apart as the cam 30 is rotated.

Figure 5:
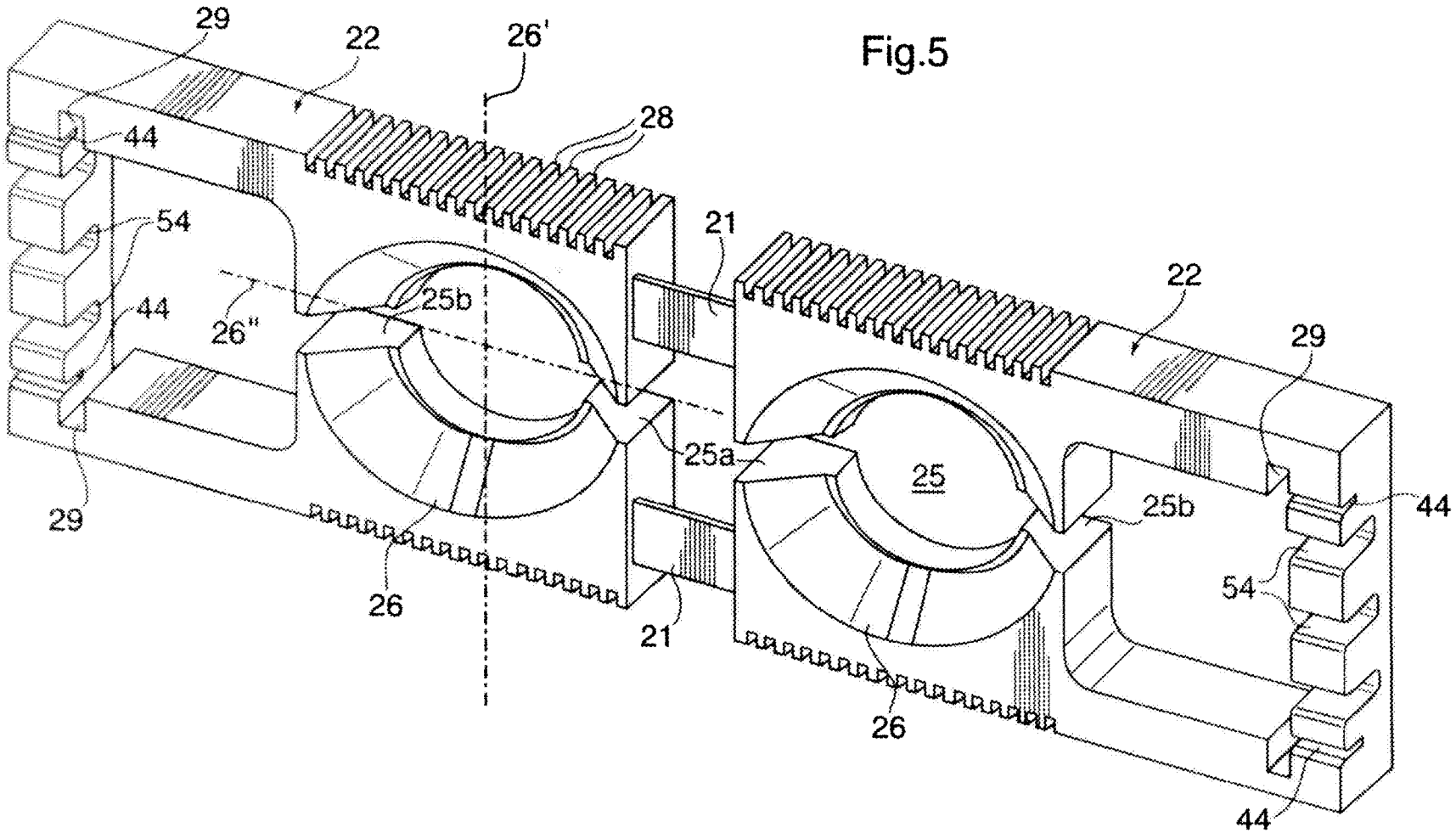
FIG. 5 is a perspective view of the parts of the shoe body in the sliding shoe of FIGS. 1 to 4.

In the preferred embodiment the annulus and cam seats 26 are also cam-shaped in complementary fashion, so the action of the cam 30 is enhanced and the shoe 20 expands very early in the rotational cycle of the cam 30, in both the horizontal and vertical directions, to provide secure locking engagement between the shoe 30 and the channel 12 when the sash is pivoted only slightly out of the plane of the frame 10. For example, as best seen in FIG. 5 the cam seat 26 is wider along an axis 26' and narrower along an axis 26" containing the slot 25*a*. Similarly, the annulus 32 is wider along an axis 32' and narrower along an axis 32", as shown in FIG. 3. Thus, the wider portion of the annulus 32 is aligned with the wider portion of the cam seat 26 when the cam 30 is in the rest (unlocked) position, and in this position the body portions 22 can abut each other.

It will be appreciated that the components of the cam 30 and the cam seat 26 are oval in the embodiment illustrated, however it is equally possible to use an elliptical, ovate or other eccentric configuration to achieve the cam effect, and the term "cam-shaped" includes all such configurations that operate as a cam.

In the preferred embodiment, the shoe portions 22 are molded as a single piece, as illustrated in FIG. 5, then the cam 30 is inserted, folding both sides of the shoe together at the webs 21 to lock the cam into position as the shoe 20 is assembled.

FIGS. 1 and 2 illustrate a biasing mechanism comprising a leaf spring 40, coiled within the frame 10 and biasing the shoe 20 to one end of the frame 10. The leaf spring 40 is fixed to an anchor plate 42, which is trapped between the shoe body portions 22 in slots 29, and the spring 40 exits the shoe 20 through slot 44. Thus, as the window sash 4 is slid toward the centre of the frame 10, the shoe 20 pulls and uncoils the leaf spring 40 which applies a bias tension to the shoe 20, so that when the window sash 4 is tilted back into the plane of the frame 10 the leaf spring 40 assists in returning the shoe 20 to the home position at the corner of the frame 10 (and thus the window sash 4 to the closed position).

Figure 4:
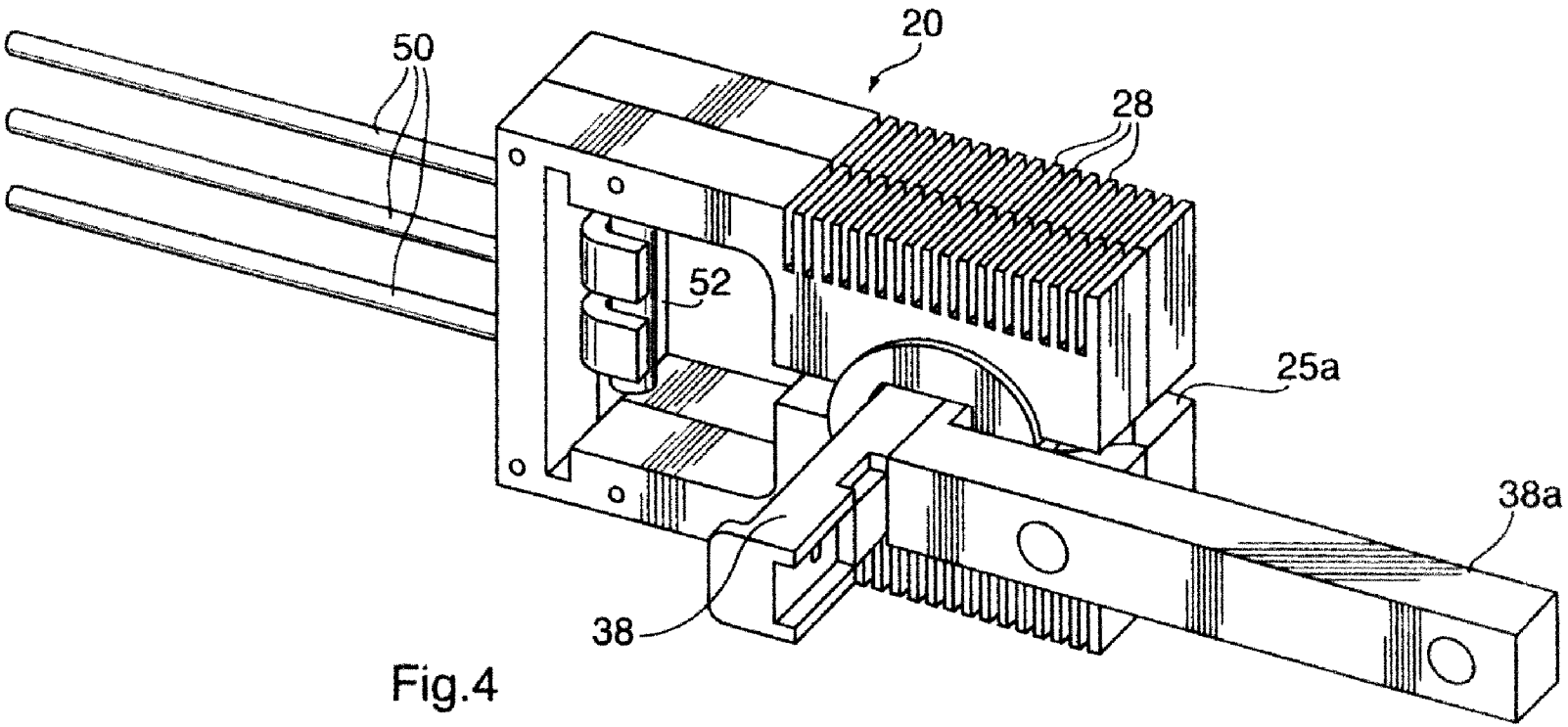
FIG. 4 is a perspective view of the assembled shoe of FIG. 2.

FIGS. 3 and 4 illustrate an embodiment of the invention used in association with a set of tensioning rods 50, which are affixed to an anchoring plate 52 that is trapped between shoe body portions 22 in slots 29, and the rods 50 exit the shoe 20 through slots 54. This embodiment works similarly to the embodiment of FIG. 1.

In use, the shoe 20 is assembled by placing the cam 30 into the cam seat 26*a* or 26*b* of one shoe portion 22, sliding the anchoring plate 42 or 52 into position in one shoe body portion 22, and closing the other shoe body portion 22 over the first to trap the anchoring plate 42 or 52 and the cam 30 in place. The keyed pivot pins 38 are mounted to the window sash 4 by inserting ends of the pivot pins 38 into sockets (not shown) in the window sash 4 and fastening bar 38*a* to the sash (e.g. as by screws). The shoes 20 are mounted to the window sash 4 by disposing the other ends of the pivot pins 38 into the receptacles 36. The window sash 4 is mounted to the frame 10 by inserting each shoe 20 into an end of the channels 12 in opposed sides (or top and bottom) of the frame 10.

Once so installed, the window 2 can be opened by sliding the window sash 4 toward the opposite end of the frame 10. The sliding shoe 20 is free to slide in the channel with the cam 30 (and thus the body portions 22) in the rest position. When the desired position for the sash 4 is reached, the sash 4 can be pivoted out of the plane of the frame 10. Pivoting the window sash 4 rotates the pivot pin 38, which in turn rotates the cam 30. As the eccentric portion 31 of the cam 30 rotates within the opening 25, the shoe 20 immediately expands laterally at split 25*a* forcing the ribs 28 to positively engage securely against the sides of the channel 12.

Figure 7A:
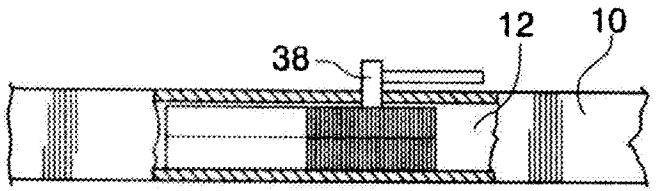
FIG. 7A is a cutaway elevational view of a frame containing the shoe of FIG. 1 with the cam in a sliding position.
Figure 7B:
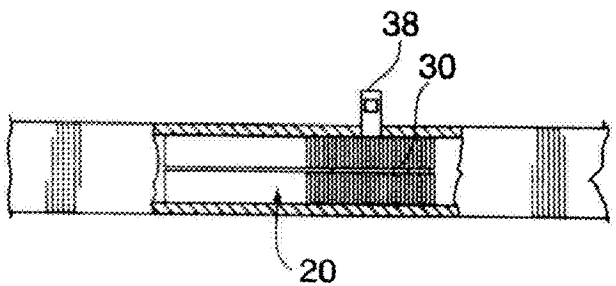
FIG. 7B is a cutaway elevational view of a frame containing the shoe of FIG. 1 with the cam in a locked position.

Further, since the cam seats 26 and annulus 32 are also cam-shaped, the shoe portions 22 abut when the cam 30 is in the rest (unlocked) position, with the wider portion 32' of the annulus 32 resting in the wider portion 26' of the cam seat 26. When the cam 30 is rotated, the wider portion 32' of the annulus 32 moves to the narrower portion 26" of the cam seat 26, forcing the shoe portions 22 apart and thus causing the shoe 20 to expand in a direction perpendicular to the direction of the lateral expansion (top-to-bottom in the orientation shown in FIG. 6B), as shown in FIG. 7B, to provide secure locking engagement between the shoe and the frame 10 along the top and bottom of the channel 12 as well.

The shoe 20 will remain in the expanded position until the window sash 4 is swung back toward the plane of the frame 10, rotating the cam 30 back to the rest position and gradually releasing the compression of the shoe 20 from the sides, and from the top and bottom, of the channel 12. The window sash 4 can then be slid back to the closed position in the frame 10.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A shoe for supporting a window sash frame in an outer frame, the shoe being slidably received in a channel in the outer frame comprising a top, a bottom and side walls, the shoe comprising a cam having a cam body and an annulus, the cam having a wider diameter and a narrower diameter, first and second mating shoe portions, each portion having an opening in communication with an end of the shoe portion, the opening having a wider diameter and a narrower diameter complementary to the cam, whereby when the cam is rotated in the opening the cam expands the shoe portions laterally, the annulus surrounding the cam body and having along an axis parallel to an axis of rotation of the cam a wider thickness and a narrower thickness, and being seated in a cam seat circumscribing the opening and having along an axis parallel to an axis of rotation of the cam a wider thickness and a narrower thickness complementary to the annulus, such that when the cam is in a rest position with the wider diameter of the cam aligned with the wider diameter of the opening, the wider thickness of the annulus is aligned with the wider thickness of the cam seat and the first and second mating shoe portions are in an unlocked position, and the cam comprising a pivot receptacle for receiving a pivot pin of a window sash in rotationally fixed relation, such that pivoting the window sash rotates the cam, whereby when the window is pivoted out of a plane containing the outer frame, as the cam body expands the shoe portions laterally the annulus cooperates with the cam seat to force the shoe portions apart and causing the shoe to expand in a direction perpendicular to the lateral expansion.

2. The shoe of claim 1 wherein the annulus and the cam seat are chamfered.

3. The shoe of claim 1 wherein the shoe portions comprise ribs along side surfaces thereof

4. The shoe of claim 3 wherein the ribs extend onto top and bottom surfaces of the shoe.

5. The shoe of claim 1 wherein the shoe portions are substantially identical.

6. The shoe of claim 5 wherein the shoe portions are joined end-to-end by webs and can be folded onto one another to form the shoe.

7. The shoe of claim 1 wherein the shoe portions comprise one or more slots for engaging a biasing member.

8. The shoe of claim 1 wherein the opening is in communication with the end of the shoe portion through a first slot.

9. The shoe of claim 8 wherein a second slot in communication with the opening is provided in diametric opposition to the first slot.

10. A window comprising a window sash frame in an outer frame, and further comprising a shoe slidably received in a channel in the outer frame comprising a top, a bottom and side walls, the shoe comprising a cam having a cam body and an annulus, the cam having a wider diameter and a narrower diameter, first and second mating shoe portions, each portion having an opening in communication with an end of the shoe portion, the opening having a wider diameter and a narrower diameter complementary to the cam, whereby when the cam is rotated in the opening the cam expands the shoe portions laterally, the annulus surrounding the cam body and having along an axis parallel to an axis of rotation of the cam a wider thickness and a narrower thickness, and being seated in a cam seat circumscribing the opening and having along an axis parallel to an axis of rotation of the cam a wider thickness and a narrower thickness complementary to the annulus, such that when the cam is in a rest position with the wider diameter of the cam aligned with the wider diameter of the opening, the wider thickness of the annulus is aligned with the wider thickness of the cam seat and the first and second mating shoe portions are in an unlocked position, and the cam comprising a pivot receptacle for receiving a pivot pin of a window sash in rotationally fixed relation, such that pivoting the window sash rotates the cam, whereby when the window is pivoted out of a plane containing the outer frame, as the cam body expands the shoe portions laterally the annulus cooperates with the cam seat to force the shoe portions apart and causing the shoe to expand in a direction perpendicular to the lateral expansion.

11. The window of claim 10 wherein the annulus and the cam seat are chamfered.

12. The window of claim 10 wherein the shoe portions comprise ribs along side surfaces thereof.

13. The window of claim 12 wherein the ribs extend onto top and bottom surfaces of the shoe.

14. The window of claim 10 wherein the shoe portions are substantially identical.

15. The window of claim 14 wherein the shoe portions are joined end-to-end by webs and can be folded onto one another to form the shoe.

16. The window of claim 10 wherein the shoe portions comprise one or more slots for engaging a biasing member.

17. The window of claim 10 wherein the opening is in communication with the end of the shoe portion through a first slot.

18. The window of claim 17 wherein a second slot in communication with the opening is provided in diametric opposition to the first slot.

19. A kit of parts for assembling a window, comprising a window sash, an outer frame for supporting the window sash, comprising a channel comprising a top, a bottom and side walls, and a shoe slidably received in the channel, comprising a cam having a cam body and an annulus, the cam having a wider diameter and a narrower diameter, first and second mating shoe portions, each portion having an opening in communication with an end of the shoe portion, the opening having a wider diameter and a narrower diameter complementary to the cam, whereby when the cam is rotated in the opening the cam expands the shoe portions laterally, the annulus surrounding the cam body and having along an axis parallel to an axis of rotation of the cam a wider thickness and a narrower thickness, and being seated in a cam seat circumscribing the opening and having along an axis parallel to an axis of rotation of the cam a wider thickness and a narrower thickness complementary to the annulus, such that when the cam is in a rest position with the wider diameter of the cam aligned with the wider diameter of the opening, the wider thickness of the annulus is aligned with the wider thickness of the cam seat and the first and second mating shoe portions are in an unlocked position, and the cam comprising a pivot receptacle for receiving a pivot pin of a window sash in rotationally fixed relation, such that pivoting the window sash rotates the cam, whereby when the window is pivoted out of a plane containing the outer frame, as the cam body expands the shoe portions laterally the annulus cooperates with the cam seat to force the shoe portions apart and causing the shoe to expand in a direction perpendicular to the lateral expansion.

20. The kit of claim 19 wherein the annulus and the cam seat are chamfered.

* * * * *